US006247772B1

(12) United States Patent
Tuttle et al.

(10) Patent No.: US 6,247,772 B1
(45) Date of Patent: Jun. 19, 2001

(54) CABINET UNIT WITH PIVOTING HEIGHT-ADJUSTABLE WORK SURFACE

(75) Inventors: Robert L. Tuttle, Saugatuck; Bryan R. Gingrich, Holland; Ronna T. Jacobs, Saugatuck; Ronald L. Lamer, Holland, all of MI (US)

(73) Assignee: Haworth, Inc., Holland, MI (US)

( * ) Notice: Subject to any disclaimer, the term of this patent is extended or adjusted under 35 U.S.C. 154(b) by 222 days.

(21) Appl. No.: 08/600,060

(22) Filed: Feb. 12, 1996

(51) Int. Cl.[7] ..... A47B 88/00
(52) U.S. Cl. ..... 312/317.3; 74/531; 108/146
(58) Field of Search ..... 108/146, 148; 312/317.3; 188/67; 74/531

(56) References Cited

U.S. PATENT DOCUMENTS

| | | | | |
|---|---|---|---|---|
| Re. 17,720 | | 7/1930 | Wheary . | |
| D. 357,781 | | 4/1995 | Crinion | D34/19 |
| 1,480,080 | | 1/1924 | Kent . | |
| 1,889,783 | | 12/1932 | Harman . | |
| 1,994,044 | | 3/1935 | Michelet | 68/10 |
| 2,404,949 | * | 7/1946 | De Lisle | 108/146 |
| 2,478,563 | | 8/1949 | Book | 16/30 |
| 2,672,921 | | 3/1954 | Herrick | 155/124 |
| 2,692,812 | | 10/1954 | Stahl | 312/310 |
| 2,755,156 | | 7/1956 | Nichols | 312/314 |
| 2,794,695 | * | 6/1957 | Heal | 108/146 |
| 2,963,332 | | 12/1960 | Breuning | 312/231 |
| 3,191,902 | * | 6/1965 | Goller | 108/146 |
| 3,878,939 | | 4/1975 | Wilcox | 206/373 |
| 3,893,400 | * | 7/1975 | Grant | 108/146 X |
| 4,502,394 | * | 3/1985 | Veyhl | 108/146 X |
| 4,572,409 | * | 2/1986 | Finnegan | 188/67 X |
| 4,709,971 | | 12/1987 | Leeds et al. | 312/201 |
| 4,872,727 | * | 10/1989 | Rye | 297/411 |
| 4,919,498 | | 4/1990 | Turner | 312/241 |
| 4,993,782 | | 2/1991 | Williams | 312/21 |
| 5,078,055 | | 1/1992 | Bellini et al. . | |
| 5,129,491 | | 7/1992 | Seidman | 190/18 A |
| 5,144,898 | * | 9/1992 | Posly | 108/148 |
| 5,429,432 | | 7/1995 | Johnson | 312/235.3 |
| 5,595,124 | | 1/1997 | Wixey et al. . | |
| 5,595,410 | | 1/1997 | Wilson et al. . | |

FOREIGN PATENT DOCUMENTS

4112180A1 10/1992 (DE) .

OTHER PUBLICATIONS

The Wall Street Journal, Workers on the Go Get a Mobile Work Space, Feb. 3, 1995, 2 pages.
Newspaper article—Box Office, Feb. 10, 1995, 1 page.

* cited by examiner

*Primary Examiner*—Peter M. Cuomo
*Assistant Examiner*—Stephen Vu
(74) *Attorney, Agent, or Firm*—Flynn, Thiel, Boutell & Tanis, P.C.

(57) ABSTRACT

A cabinet unit comprising a base unit that defines a first work surface and a pivoting table top which defines a second work surface. The pivoting table top has one end mounted to the base unit by a telescoping pivot assembly, and at the opposite end is supported by a telescoping support leg. The pivot assembly and the support leg each have a lockable height adjustment mechanism such that the pivot assembly permits the table top to be horizontally angularly moved between a closed position overlying the first work surface and an open position extending away from the first work surface, while permitting adjustment of the height of the second work surface.

18 Claims, 7 Drawing Sheets

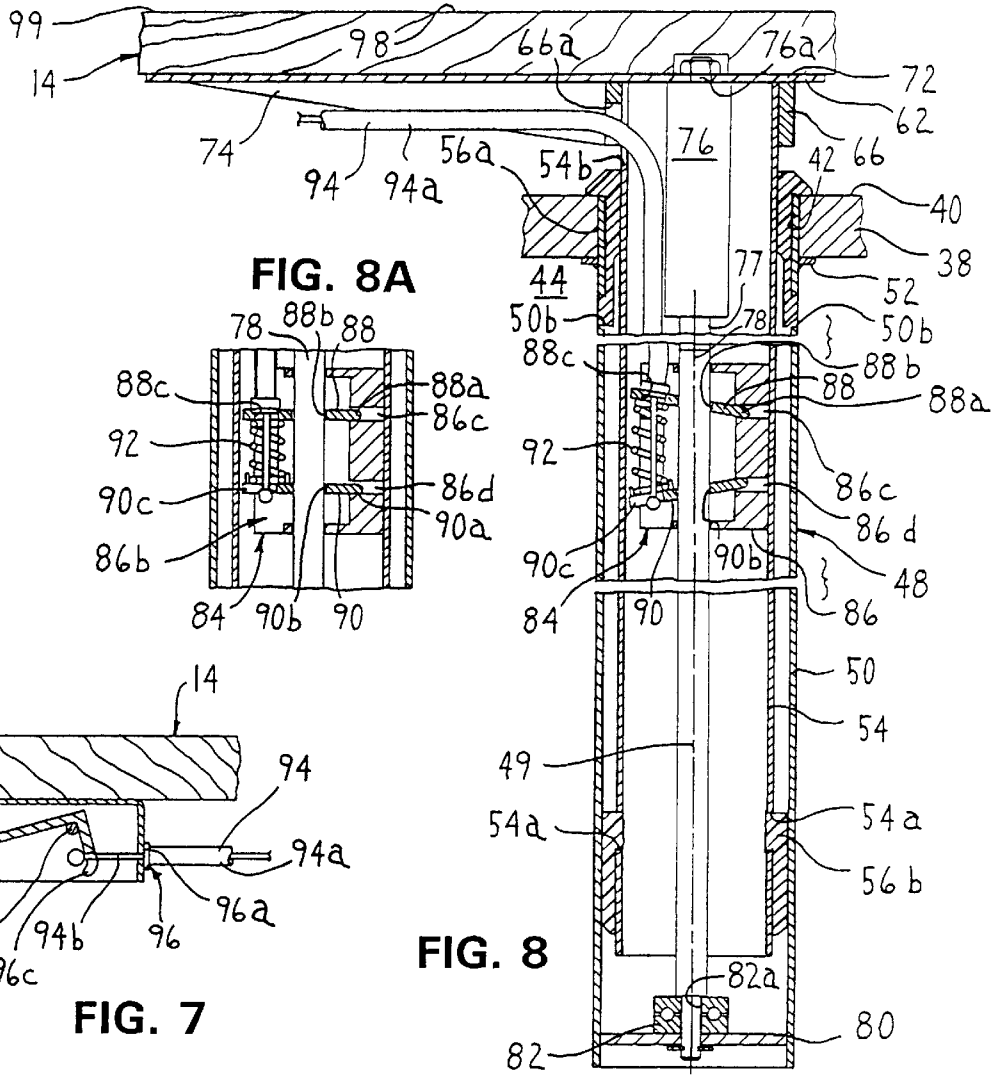
FIG. 8
FIG. 8A
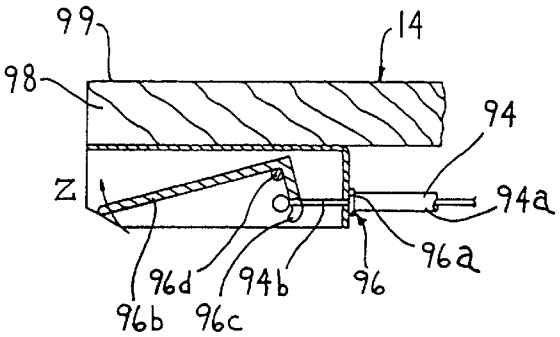
FIG. 7
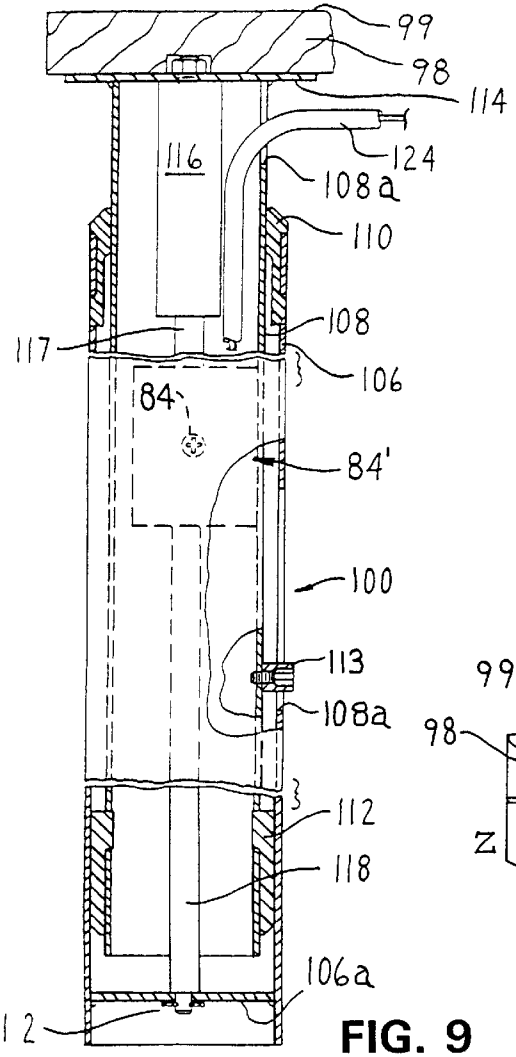
FIG. 9

CABINET UNIT WITH PIVOTING HEIGHT-ADJUSTABLE WORK SURFACE

FIELD OF THE INVENTION

This invention relates to a portable cabinet unit for an office and, more specifically, to an improved portable cabinet unit expandable between an open condition for use and a closed condition for repositioning and storage.

BACKGROUND OF THE INVENTION

In the typical office environment, a relatively large, open office area is divided into a selected arrangement of office workstations by any of a number of commercially available wall panel systems. These wall panel systems include wall panels which are adapted to mount thereon a wide variety of shelves, cabinets, work surfaces and other panel-mounted components and systems furniture.

As an alternative to the panel systems, workstations may also be formed by stand-alone transportable workstations which are readily repositioned and opened for use, and readily closed for storage and transport. Such stand-alone workstations can be used in such locations as, for example, home offices, hotels which accommodate business travelers, or office areas intermittently used for a wide variety of office activities.

Accordingly, a need exists for a cabinet unit having a variable-position work surface which compliments, for example, the panel system or stand-alone workstations of the type described above, or which can be used as a small stand-alone workstation. In particular, most conventional office furniture products are not sufficiently portable or sufficiently compact for use with existing workstations, and are not easily and compactly storable so as to facilitate quick set up and take down, so as to permit use in combination with available panel systems and stand-alone workstations.

The present invention relates to an improved cabinet unit having a pivoting height-adjustable work surface, which cabinet unit is readily portable and storable and usable either as a stand-alone work area or integrated with existing systems furniture. In a preferred embodiment, the pivoting work surface is attached to a base unit and overlies a table top of the base unit when in a closed position. The pivoting work surface is usable in the closed position but preferably is pivoted to an open position to expose the cabinet table top.

The improved cabinet unit, when in the closed condition, is readily moveable for storage or for permitting reconfiguration of the office space by moving the cabinet unit adjacent an existing workstation or to its own assigned area for use as a stand-alone work area. Such storability and flexibility is readily satisfied by the pivoting, height-adjustable work surface which is rotatable to the closed position and locked by adjusting the height of the worksurface. As a result, the cabinet unit is easily repositioned to a storage area or to another work location.

Once repositioned for use, the cabinet unit is readily reopened by raising the work surface and pivoting the work surface relative to the base unit of the cabinet into a selected angular position for use either as a stand-alone unit or in combination with preexisting workstations. When pivoted to the open position, the pivoting work surface has an open area underneath so as to be usable as a desk while the cabinet top is usable as an auxiliary work surface. Since the base unit can include file drawers, shelves or the like, the inventive cabinet unit is able to serve a wide variety of functions in a typical office environment.

Other objects and purposes of the invention will be apparent to persons familiar with structures of this general type upon reading the following specification and in inspecting the accompanying drawings.

BRIEF DESCRIPTION OF THE DRAWINGS

FIG. 7 is a partial side cross sectional view of an actuator mechanism for the height adjustment mechanism.

FIG. 8 is a partial rear cross sectional view illustrating a pivot assembly for the work surface.

FIG. 8A is a partial rear cross sectional view illustrating the locking mechanism of FIG. 8 in a release position.

FIG. 9 is a partial rear cross sectional view illustrating a telescoping support leg of the work surface.

DETAILED DESCRIPTION

Figure 1A:
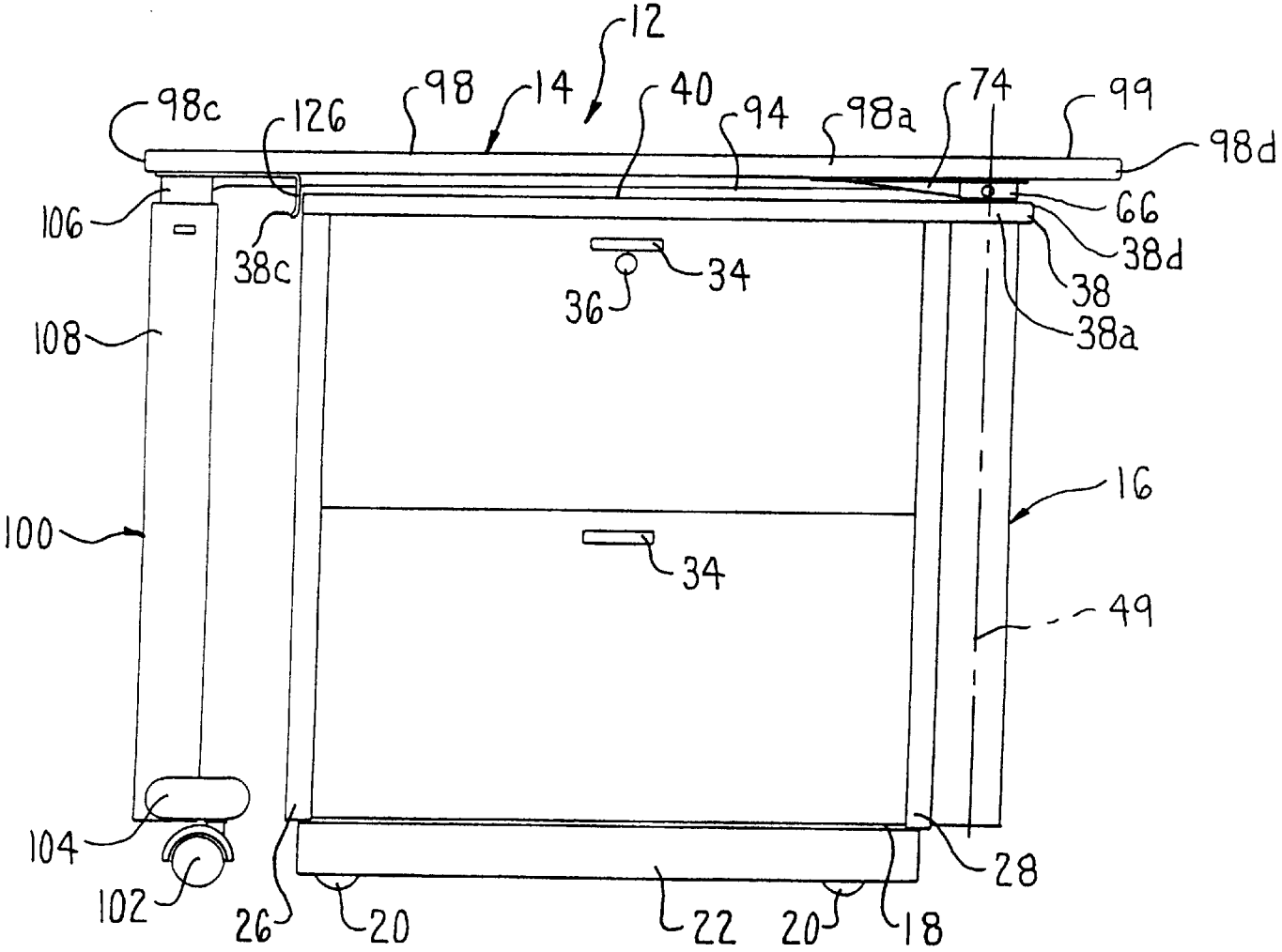
FIG. 1A is a front elevational view illustrating a preferred embodiment of a cabinet unit according to the present invention with the pivoting height-adjustable work surface shown in a closed, locked position.
Figure 1B:
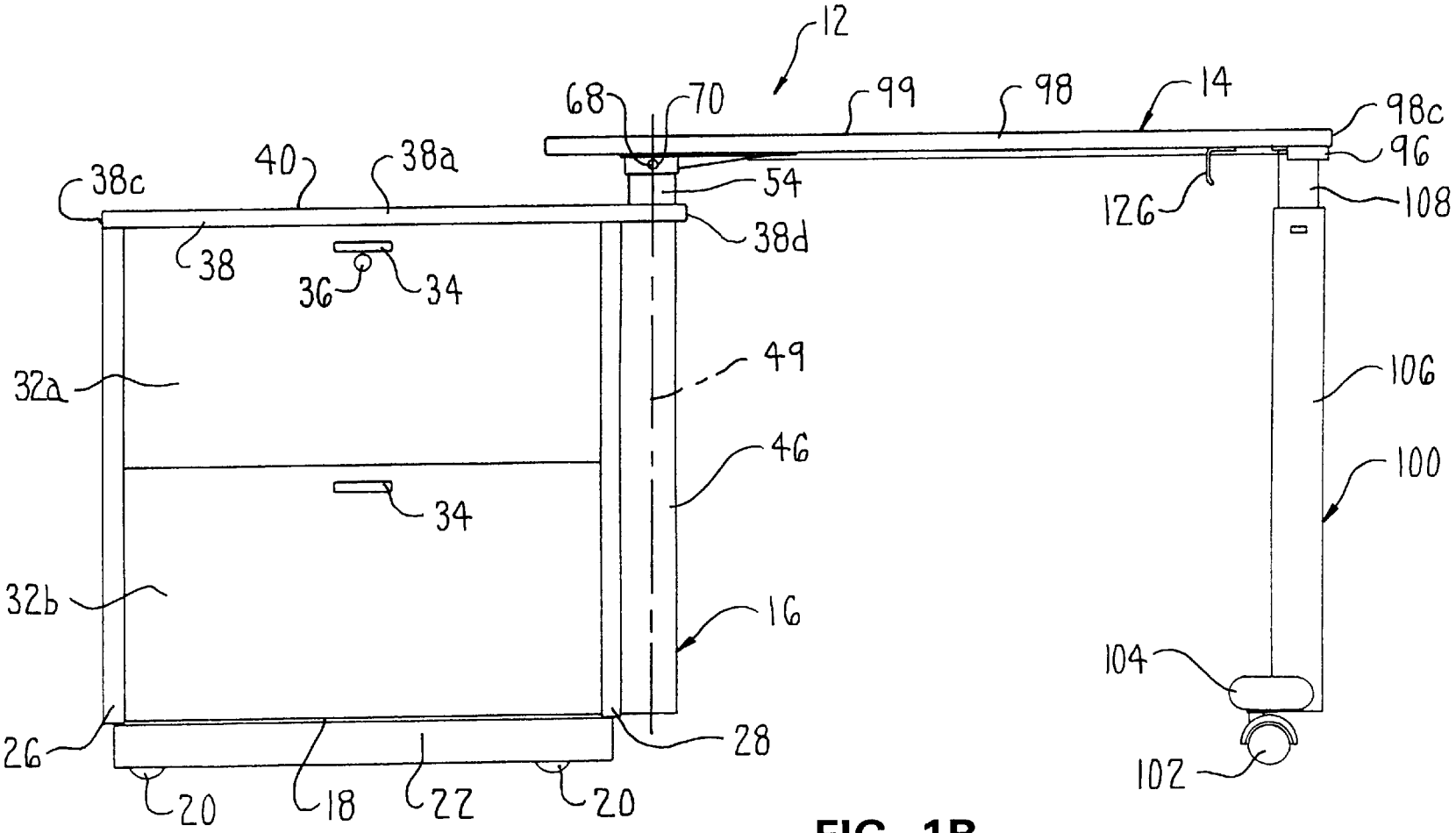
FIG. 1B is a front elevational view illustrating the cabinet unit with the work surface adjusted upwardly to a selected height and pivoted to a fully open position

Referring to the drawings and specifically FIGS. 1A and 1B, a cabinet unit 12 with a pivoting height-adjustable work surface 14 is illustrated according to the present invention. FIG. 1A illustrates the work surface 14 in a closed, locked position, and FIG. 1B illustrates the work surface 14 in a fully open position.

Figure 3:
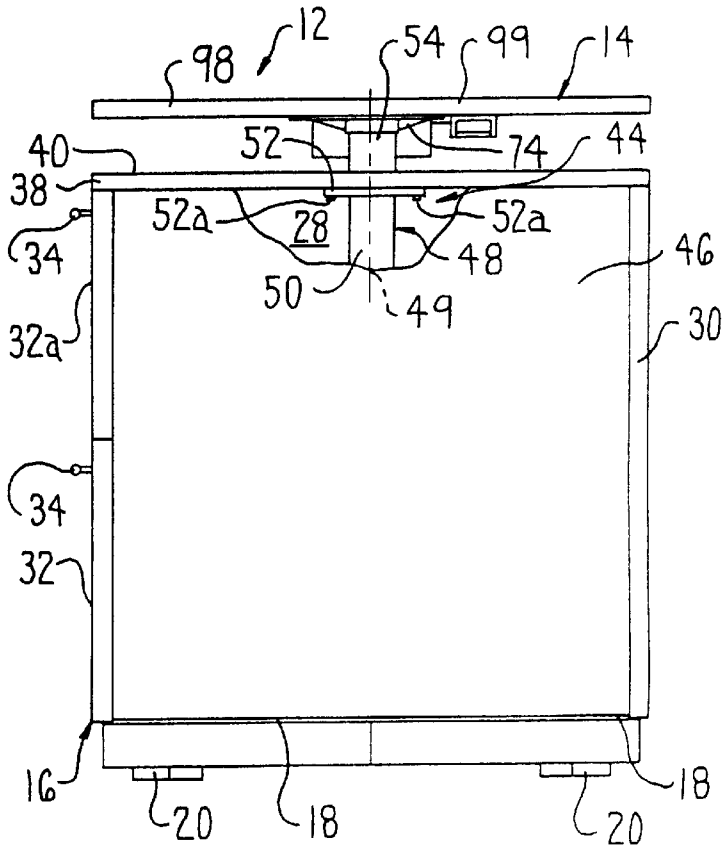
FIG. 3 is a right side view of the cabinet unit of FIG. 2 with an end cover panel shown partially removed.
Figure 2:
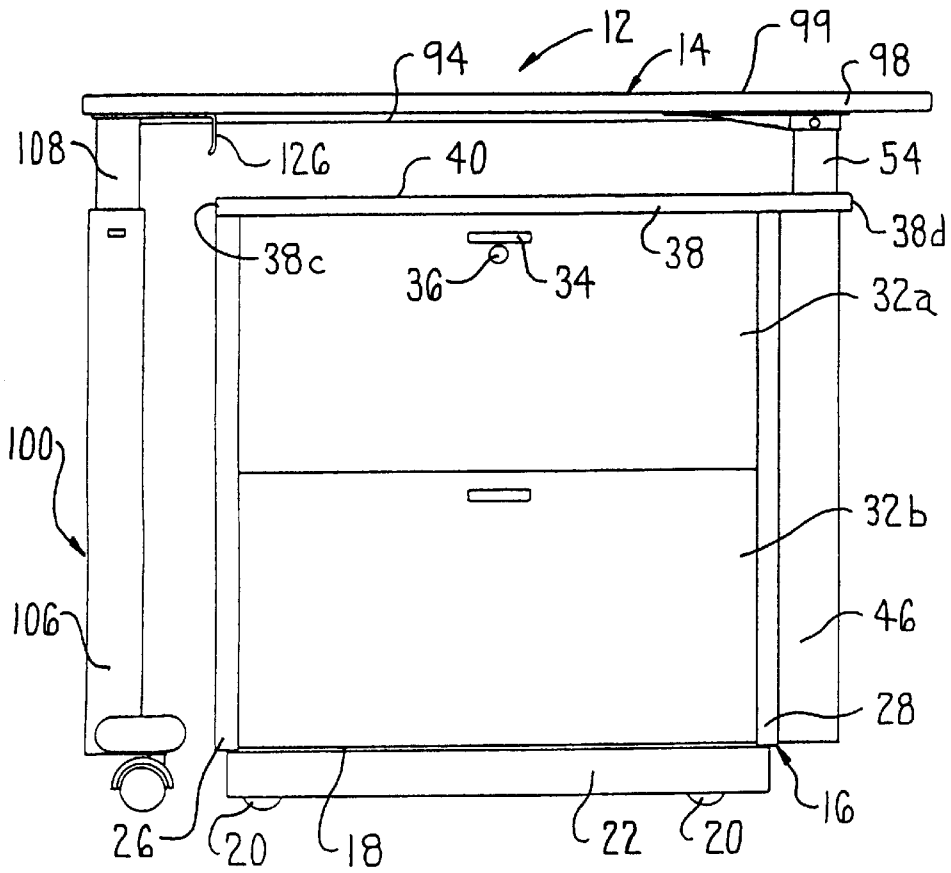
FIG. 2 is a front elevational view illustrating the work surface adjusted upwardly in a closed, unlocked position.
Figure 5:
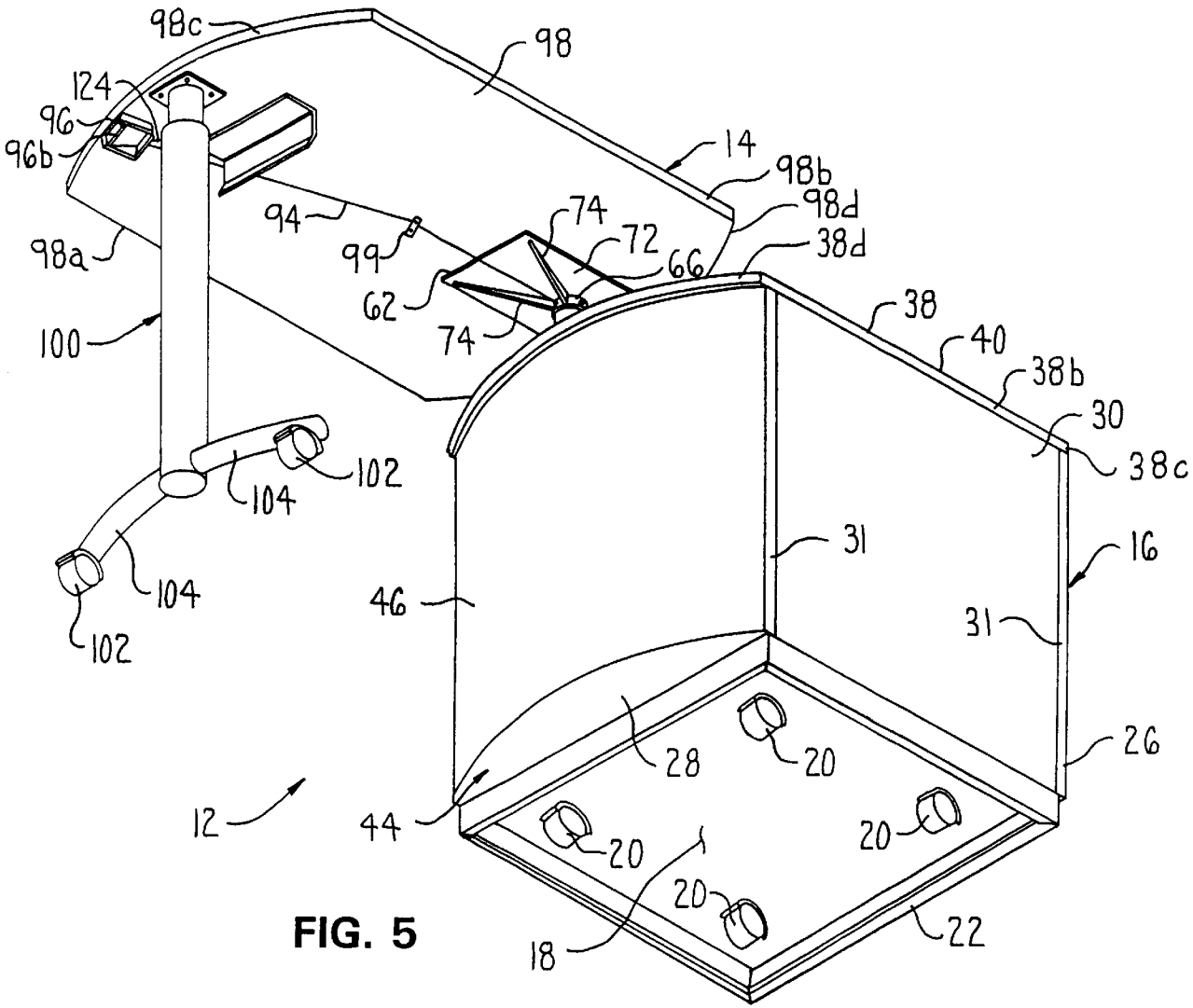
FIG. 5 is a perspective view as viewed from the bottom rear of the cabinet unit with the work surface pivoted to the fully open position.

Referring to FIGS. 1A, 2 and 3, the cabinet unit 12 includes a readily moveable hollow base or housing unit 16 which preferably has a box-like shape. More particularly, the base unit 16 includes a rectangular horizontal bottom panel 18 which is supported on a floor surface (not illustrated) by a plurality of caster assemblies 20. Referring to FIG. 5, the bottom panel 18 preferably has the caster assemblies 20 projecting downwardly therefrom proximate the four corners of the bottom panel 18. The caster assemblies 20 are of a conventional construction although any suitable construction may be used so long as the base unit 16 is readily movable. To substantially enclose the space between the floor (not illustrated) and the bottom panel 18, a box-like four-sided bottom skirt 22 is mounted to a lower surface of the bottom panel 18 and extends around the periphery of the bottom panel 18.

The base unit 16 also includes two spaced apart upstanding end walls 26 and 28. The end walls 26 and 28 have a substantially rectangular shape (FIG. 3) and have a lower edge fixedly secured to the bottom panel 18 near the respective opposite side edges thereof. Preferably, the end walls 26 and 28 extend upwardly a predetermined distance to define a cabinet work surface height as will be described hereinafter.

Referring to FIGS. 3 and 5, the base unit 16 also includes a vertical rear wall 30 which extends sidewardly between the end walls 26 and 28 and upwardly from the bottom panel 18 to enclose the rear side of the base unit 16. Preferably, the corners of the base unit 16 include vertically extending corner extrusions 31 for enclosing the corners and joining the respective end walls 26 and 28 and rear wall 30 together by vertical channels (not illustrated) of the corner extrusions 31. While the base unit 16 in the preferred embodiment has fully enclosed end walls 26 and 28 and rear wall 30, the base unit 16 may also have an open frame construction or other suitable configuration.

In the illustrated preferred embodiment, the front side of the base unit 16 is open, and two box-like drawer assemblies 32*a* and 32*b* (FIGS. 2 and 3) are slidably supported within the open space between the opposite end walls 26 and 28, which drawer assemblies 32*a* and 32*b* are of conventional rectangular construction having handles 34 and at least one lock assembly 36. While preferred, the drawer assemblies 32*a* and 32*b* as positioned in the open space between the opposite end walls 26 and 28 may be replaced with partitions, shelves or the like, or combinations thereof.

Figure 4:
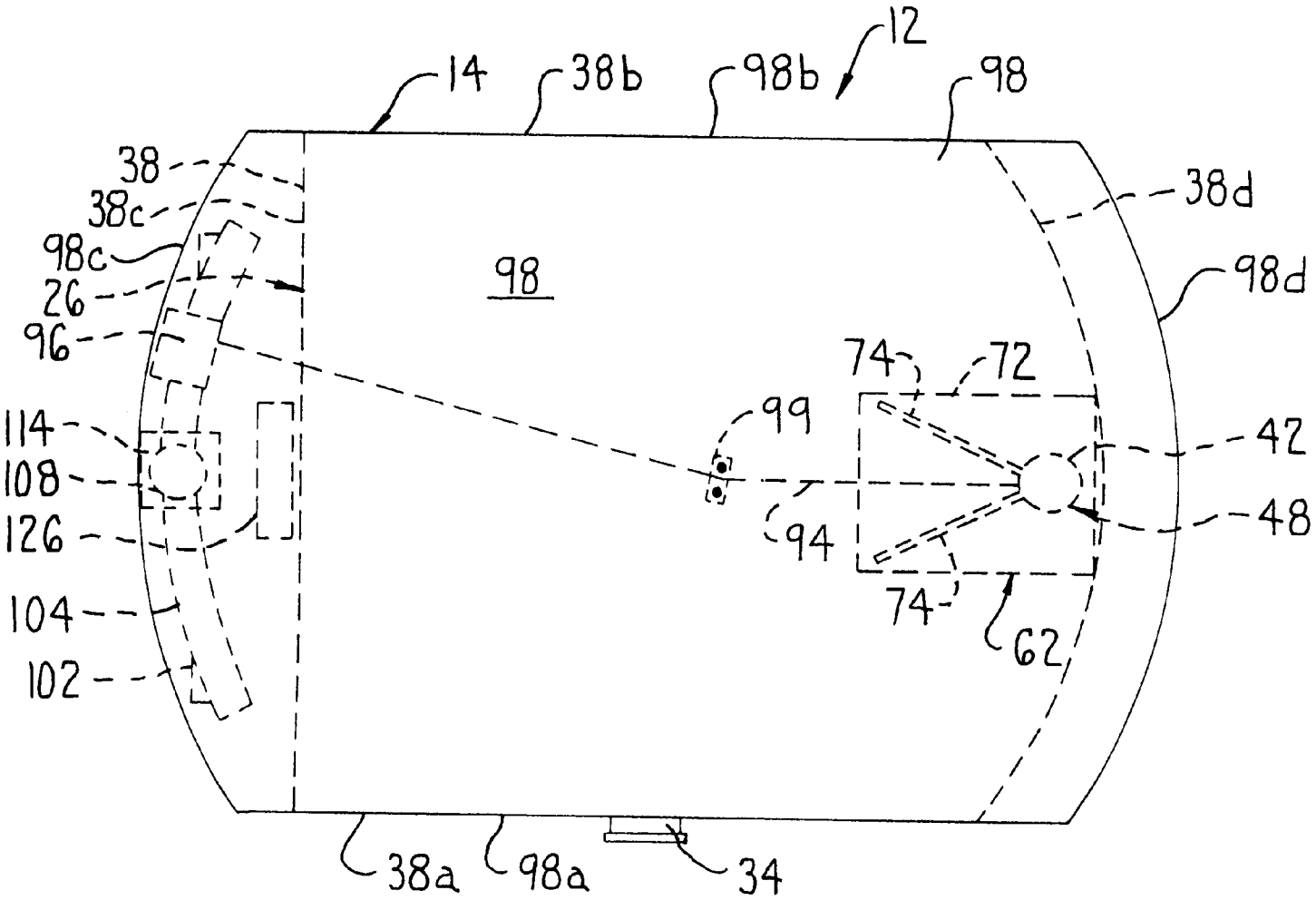
FIG. 4 is a top plan view of the cabinet unit of FIG. 1.

The base unit 16 also includes a horizontal planar cabinet top 38 which is fixedly supported on the upper edges of the opposite end walls 26 and 28. The cabinet top 38 defines an upward facing horizontal planar cabinet work surface 40 which extends between the opposite ends of the base unit 16. Referring to FIGS. 4 and 5, the cabinet top 38 is defined by a front edge 38*a*, a rear edge 38*b*, a linear straight edge 38*c* proximate the end wall 26, and an arcuate convex end edge 38*d* proximate the end wall 28.

Preferably, the straight edge 38*c* is substantially parallel with respect to the end wall 26, while the arcuate edge 38*d* extends sidewardly beyond the end wall 28 a predetermined distance to define an overhanging region. Within the overhanging region of the cabinet top 38 proximate the end wall 28, a circular passage 42 opens vertically therethrough as illustrated in FIGS. 4 and 8. More particularly, the circular passage 42 opens upwardly from the upper work surface 40 of the cabinet top 38 and downwardly from a lower surface into a side chamber 44, which chamber 44 is defined between the end wall 28 and an arcuately shaped convex cover panel 46 as shown in FIGS. 3 and 5. The cover panel 46 has spaced apart vertical edges fixedly secured to the end wall 28 and an intermediate region which bows outwardly away from the end wall 28.

To permit pivoting of the work surface 14 to selected angular positions between the fully open position (FIG. 1B) and the closed position (FIG. 1A), a pivot assembly 48 (FIG. 3) is secured to the cabinet top 38 and extends downwardly within the side chamber 44. In the preferred embodiment, the pivot assembly 48 is of a telescoping construction as illustrated in FIGS. 3 and 8 which thereby defines a vertical pivot axis 49.

The pivot assembly 48 includes an outer tubular member 50 which is oriented substantially vertical within the side chamber 44. The outer tubular member 50 is hollow and has a mounting flange 52 at an upper end thereof which is fastened to the bottom surface of the cabinet top 38 by fasteners 52*a* or the like. Preferably, the outer tubular member 50 has a circular cross section. The outer tubular member 50 also includes bearing engagement apertures 50*b* at its upper end.

To not only permit pivoting but also vertical adjustment of the height of the work surface 14, an inner tubular member 54 is slidably and concentrically disposed within the interior of the outer tubular member 50 and projects upwardly out of the outer tubular member 50 through the passage 42. The inner tubular member 54 is slidably supported by an upper annular bearing 56*a* disposed proximate the circular passage 42, and a lower annular bearing 56*b* which is fixed to the lower end of the inner tubular member 54 so as to permit vertical sliding of the inner tubular member 54 into and out of the outer tubular member 50. The upper annular bearing 56*a* is fixed to the outer tubular member 50 by radially outwardly projecting portions which resiliently seat within the bearing engagement apertures 50*b*. Similarly, the lower annular bearing 56*b* is fixed to the inner tubular member 54 by radially inwardly projecting portions of the lower annular bearing 56*b* which seat within corresponding bearing engagement apertures 54*a* formed through the wall of the inner tubular member 54. The inner tubular member 54 also includes a cable passage 54*b* through the side wall thereof at the upper end thereof.

To mount the inner tubular member 54 to the work surface 14, a mounting bracket 62 is fixed to the upper end of the inner tubular member 54. The mounting bracket 62 includes a cup-shaped downwardly opening seat 66 which receives the upper end of the inner tubular member 54 therein and is secured to the inner tubular member 54 by fasteners 68 (FIG. 1B) which extend through corresponding bores 70 formed through the peripheral wall of the seat 66. Referring to FIGS. 5 and 8, the seat 66 depends downwardly from a planar, substantially rectangular mounting plate 72 which is oriented horizontally so as to support the work surface 14. The mounting plate 72 extends outwardly away from the seat 66 a predetermined distance to provide cantilevered support to the work surface 14, which cantilevered support is further strengthened by two substantially triangular webs 74 which extend radially outwardly away from the seat 66. The seat 66 also includes a cable passage 66*a* which opens outwardly from the peripheral wall of the seat 66 in the region between the spaced apart innermost ends of the webs 74 and is aligned with the cable passage 54*b* of the inner tubular member 54.

To provide a lifting force for vertical adjustment of the height of the work surface 14, an upward biasing means 76 (FIG. 8), such as a conventional gas cylinder of the type commonly known as a gas spring, is mounted to the mounting bracket 62 by a threaded projection 76*a* which extends from an upper end of the gas cylinder 76 through an aperture 72*a* of the mounting plate 72 and is secured by a weld nut. The gas cylinder 76 projects coaxially downwardly into the interior of the inner tubular member 54 and has a reciprocating piston rod 77 of conventional construction which extends downwardly therefrom. The reciprocating shaft 77 has a distal end which is fixedly secured to one end of an extension rod 78. The opposite bottom end of the extension rod 78 is fixed relative to the outer tubular member 50 which itself is fixed to the cabinet top 38 of the base unit 16 as described above. As a result, relative movement of the gas cylinder 76 with respect to the extension rod 78 causes the inner tubular member 54 to move either upwardly or downwardly so as to cause a corresponding upward or downward movement of the work surface 14.

To fix the bottom end of the extension rod 78 relative to the outer tubular member 50, an end cap 80 is inserted and fixed within a lower end of the outer tubular member 50 and the rod 78 is rotatably secured to the end cap 80 by a snap ring clip. To permit pivoting movement of the work surface 14, a thrust bearing 82 is disposed between the end cap 80 and a shoulder on the extension rod 78. The bearing 82 includes an interior bore 82*a* which opens upwardly and receives the bottom end of the extension rod 78 therethrough. The thrust bearing 82 is provided so as to permit rotation of the gas cylinder 76 and extension rod 78 relative to the outer tubular member 50 during pivoting of the work surface 14. With the above-described telescoping arrangement, the work surface 14 not only is pivotable about axis 49 between the closed position (FIG. 1A) and the fully open position (FIG. 1B), but is also vertically movable between a lower position (FIG. 1A) and an upwardly displaced position (FIG. 2).

Figure 6:
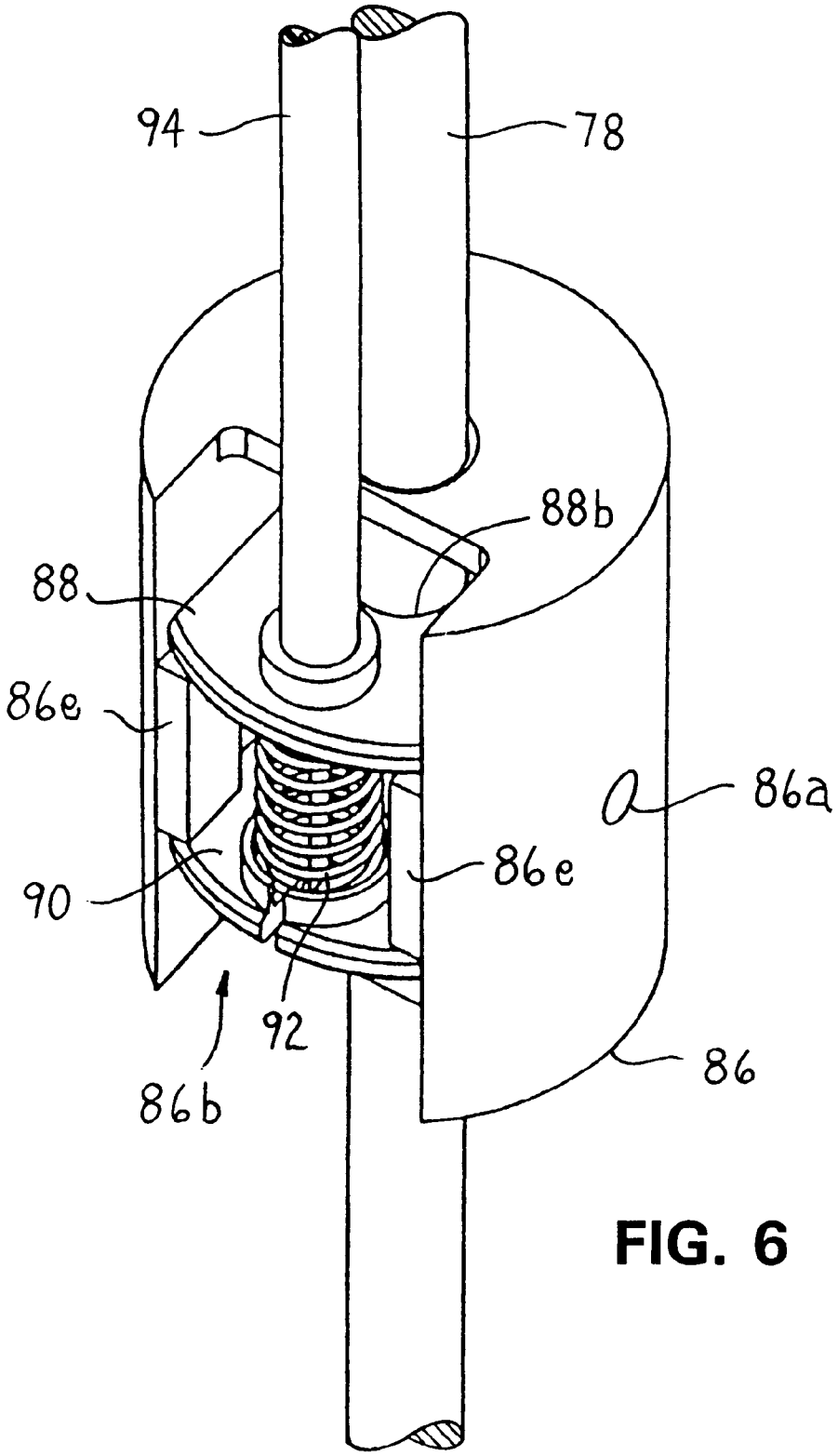
FIG. 6 is a partial perspective view of a representative height adjustment mechanism illustrated in a release position.

More particularly with respect to vertical movement, to restrain the work surface 14 at a selected height between the upper and lower positions, a locking mechanism 84 (FIGS. 6, 8 and 8A) is fixedly secured within the inner tubular member 54 by fasteners (not illustrated) which extend through the inner tubular member 54 and threadedly engage fastener bores 86*a* which are formed in the opposite sides of a locking housing 86. The housing 86 includes a vertical central passage 86*b* which extends vertically therethrough and slidably receives the extension rod 78 therethrough. The housing 86 also defines therein inward opening upper and lower notches 86*c* and 86*d* (FIG. 8) as well as opposing side stops 86*e* (FIG. 6) disposed within the interior 86*b* thereof.

To facilitate locking of the inner tubular member 54 relative to the extension rod 78, the locking mechanism 84 includes an upper locking plate 88 which has one end 88*a* pivotally secured within the upper notch 86*c* as illustrated in FIG. 8, and a lower locking plate 90 which similarly has one end 90*a* pivotally supported in the lower notch 86*d*. The upper locking plate 88 includes a central aperture 88*b*, and the lower locking plate 90 similarly has an aperture 90*b* which is vertically aligned with the aperture 88*b* to permit the extension rod 78 to extend through the upper and lower locking plates 88 and 90. The upper locking plate 88 includes an open seat 88*c* and the lower locking plate 90 includes an open-ended slot 90*c* for operating the locking mechanism 84.

To lock the extension rod 78 relative to the inner tubular member 54 as shown in FIG. 8, a coil spring 92 is secured by its opposite ends to the respective upper and lower locking plates 88 and 90. The spring 92 serves to normally press the locking plates 88 and 90 away from each other in order to frictionally engage the extension rod 78 and prevent relative movement of the extension rod 78 with respect to the locking mechanism 84, and thereby with respect to the inner tubular member 54 to which the locking mechanism 84 is secured.

To unlock the locking mechanism 84 and allow relative movement of the extension rod 78, the upper and lower locking plates 88 and 90 are operatively connected to an actuator cable 94 which has an outer cable sheath 94*a* fixed at one end in engagement with the seat 88*c* of the upper locking plate 88 (FIG. 8) and at an opposite end to a housing 96*a* of an actuator 96 (FIG. 7).

The actuator cable 94 also includes an inner coaxial cable 94*b* slidably and coaxially retained within the cable sheath 94*a*. The inner cable 94*b* slidably extends through the seat 88*c* and has an expanded diameter end engaged with the lower locking plate 90 through the open-ended slot 90*c* as shown in FIG. 8. Referring to FIG. 7, the inner cable 94*b* has an opposite expanded diameter end engaged to an L-shaped pivot lever 96*b* of the actuator 96 through an open-ended slot 96*c*. The lever 96*b* pivots about a lever shaft 96*d* rotatably supported by the housing 96*a*.

Normally, the spring 92 presses the upper and lower locking plates 88 and 90 away from the other while at the same time displacing the inner cable 94*b* away from the actuator lever 96*b* for locking of the extension rod 78 (FIG. 8). To unlock the extension rod 78 (FIG. 8A), however, the lever 96*b* is pivoted about the shaft 96*d* so as to pull the inner cable 94*b* away from the locking mechanism 84 and compress the upper locking plate 88 and the lower locking plate 90 one towards the other until contacting the side stops 86*e*. Once the actuator lever 96*b* is released, the locking plates 88 and 90 return to the locking position (FIG. 8) in response to the expansion force of the spring 92. Thus, with selective operation of the actuator lever 96*b*, the locking mechanism 84 can be released for raising and lowering of the work surface 14 to a selected work surface height and then engaged for retaining the work surface 14 at the selected height.

Referring to FIGS. 4 and 5, the work surface 14 is defined by a table top 98 which is substantially planar and oriented horizontally, and defines thereon a horizontally planar and upwardly-facing top surface 99. The table top 98 has one end secured to the mounting bracket 62 of the pivot assembly 48 while the opposite end extends outwardly in a cantilevered manner away from the mounting bracket 62. The table top 98 is defined by generally parallel side edges 98*a* and 98*b*, which are joined by convex arcuate end edges 98*c* and 98*d*. The table top 98 is secured to the mounting bracket 62 such that the arcuate end edge 98*d* extends outwardly beyond the arcuate edge 38*d* of the cabinet top 38 when in the closed position (FIG. 1A) while the opposite arcuate end edge 98*c* extends outwardly beyond the straight edge 38*c* of the cabinet top 38 which is disposed below the table top 98. The table top 98 has the actuator 96 mounted to the bottom surface thereof proximate the side edge 98*a* along with the actuator cable 94 which extends from the pivot assembly 48 through a cable support bracket 99 to the actuator 96.

The free end of the table top 98 is supported by a height-adjustable telescoping support leg 100. The lower end of the support leg 100 is adapted to contact a support surface or floor (not illustrated) by spaced apart caster assemblies 102 which are connected to projecting support arms 104 as shown in FIG. 5. Referring to FIGS. 2 and 4, the support leg 100 is positioned so as to be a predetermined distance from the pivot assembly 48 such that during pivoting of the work surface 14 about the pivot assembly 48, the support leg 100 is able to be moved adjacent the straight edge 38*c* without interfering with the front and rear corners of the cabinet top 38. Thus, the table top 98 is freely pivotable to any selected angular position between the closed position (FIG. 1A) and the open position (FIG. 1B) which is oriented 180° about a pivot path away from the closed position.

To permit vertical adjustment of the height of the table top 98 from a lowermost height (FIG. 1A) disposed closely adjacent the cabinet top 38 and an uppermost height (FIG. 2) disposed upwardly away from the cabinet top 38, the support leg 100 includes an outer tubular member 106 and an inner tubular member 108 as shown in FIG. 9. The support leg 100 is constructed substantially the same as the pivot assembly 48 with the differences being described herein. Like the pivot assembly 48, the inner tubular member 108 is slidably supported by an upper annular bearing 110 retained in the outer tubular member 106, and a lower annular bearing 112 retained on the lower end of the inner tubular member 108. Rotation of the outer tubular member 108 relative to the inner tubular member 108, however, is prevented by a stop 113 which is threadedly engaged to the inner tube 108 and projects radially outwards through a vertically elongate channel 108*a* in the outer tube 108 which slidably receives the stop 113. The inner tubular member 108 also includes an upper mounting plate 114 fixedly secured to an upper end thereof which is subsequently fastened to a lower surface of the table top 98 by fasteners (not illustrated) or the like.

To permit telescoping movement of the inner tubular member 108 relative to the outer tubular member 106, a pressure cylinder 116 is mounted to the mounting plate 114 and has a piston rod 117 connected to an extension rod 118 which extend downwardly therefrom. The extension rod 118 has a lower end fixedly connected to an end plate 106*a* of the outer tubular member 106 by a snap ring clip engagement portion 122. A locking mechanism 84' substantially identical to the locking mechanism 84 described above with respect to the pivot assembly 48 is mounted to the inner tubular member 108 so as to engage the extension rod 118. The locking mechanism 84' is operatively engaged with a second actuator cable 124 which extends through a cable passage 108*a* and is also connected to the actuator 96. More particularly, the actuator cable 124 angles away from the support leg 100 as shown in FIG. 4, and then extends to the actuator 96. The above-described structures of the support leg 100 operates substantially the same as the corresponding structures in the pivot assembly 48 with the most substantial difference being that the extension rod 78 pivots with respect to the outer tubular member 50 in the pivot assembly 48, while the extension rod 118 need only be fixed to the outer tubular member 106 in the support leg 100. When manually actuating the actuator 96, the two locking mechanisms 84 and 84' are released simultaneously to permit vertical adjustment of the height of the table top 98.

To lock the table top 98 in the closed position (FIGS. 1A and 1B), the table top 98 has a L-shaped locking bracket 126 fixed thereunder with one leg thereof projecting downwardly. The locking bracket 126 is positioned closely adjacent the straight edge 38*c* of the cabinet top 38 as illustrated in FIG. 4. More particularly, when the table top 98 is disposed in the lowermost position illustrated in FIG. 1A, the locking bracket 126 is positioned so as to contact the straight edge 38*c* when pivoting of the table top 98 is attempted. To unlock the table top 98, the locking mechanisms 84 and 84' of the pivot assembly 48 and the support leg 100 are released by the actuator 96 so as to permit vertical upward movement of the table top 98 to the unlocked position illustrated in FIG. 2. When disposed in the unlocked position, the locking bracket 126 is disposed in a noninterfering relation with the straight edge 38*c* so as to permit pivoting movement of the table top 98 into the open position.

In operation, the cabinet unit 12 typically is moved about with the table top 98 disposed in the closed, locked position (FIG. 1A). When in this closed lock position, the work surface 14 is exposed for use if desired.

Once the cabinet unit 12 is positioned in a desired location, for example, adjacent a preexisting workstation or in a desired position for stand-alone use, the lever 96*b* of the actuator 96 is pressed upwardly (as indicated by arrow Z in FIG. 7) so as to release the locking mechanisms 84 and 84' which permits the table top 98 to be moved upwardly toward the unlocked position (FIG. 2) due to the urging of the gas cylinder 76. When the table top 98 reaches the desired height or elevation, as controlled by the individual who is controlling the actuator 96 of the lock mechanisms, then the actuator lever 96 is released so that the lock mechanisms reengage, thereby locking the height of the adjustable legs and thereby locking the table top 98 at the desired height. The work surface 14 can then be pivoted about axis 49 to any desired angular position along the pivot path between the closed position (FIG. 2) and the fully open position (FIG. 1B). For example, while the work surface 14 is illustrated in a fully open position located 180° away from the cabinet top 38 in FIG. 1B, the work surface 14 can be located at an angular position, for example, 90° either clockwise or counterclockwise from the closed position so that the work surface 14 is oriented at a right angle with respect to the cabinet work surface 40. With the above-described arrangement, the cabinet unit 12 is readily usable either as a stand-alone unit or in combination with preexisting workstations or furniture.

Conversely, when closure of the cabinet unit 12 is desired, then the table top 98 is again manually pivoted relative to the cabinet housing about the axis 49 so that the top 98 effectively directly overlies and is positioned upwardly above the cabinet top 38, whereupon the height-adjusting leg 100 is now disposed closely adjacent the end wall 26 of the cabinet housing. When in this position, substantially as illustrated by FIG. 2, the actuator lever 96 is again manually pressed or pivoted upwardly so as to release the locking mechanisms 84 and 84'. The operator then manually presses downwardly on the table top 98 so as to vertically downwardly telescope the leg assembly 100 and the pivot assembly 48. When the table top 48 is depressed into its lowermost position wherein it is disposed directly over the cabinet top 38, as illustrated in FIG. 1A, then the actuator lever 96 is manually released whereupon the locking mechanisms 84 and 84' reengage and thereby securely hold the top 98 in the lowered closed position. In this lowered closed position, the lock bracket 126 also is disposed closely adjacent the end edge 38*c* of the cabinet top 38 to effectively prevent relative pivoting movement of the top 98 about the axis 49 relative to the base cabinet.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A free-standing cabinet unit comprising:

a base unit having a first upright end portion, a second upright end portion opposite said first end portion, and a top wall defining an upward facing first work surface fixed to and disposed between said first and second end portions;

a pivoting table top defining an upward facing second work surface and having a first table end portion, and a second table end portion opposite said first table end portion;

a vertically elongate support means mounted on and depending downwardly from said table top for contact with a support surface;

pivot means pivotally connected between said first table end portion and said base unit in the vicinity of said first upright end portion for enabling substantially horizontal pivoting movement of said table top relative to said base unit about an upright-oriented pivot axis between a closed position wherein said first and second table end portions are disposed respectively adjacent said first and second upright end portions so that said table top overlies said top wall and an open position wherein said second table end portion is horizontally pivoted outwardly away from said second upright end portion;

said pivot means including first height adjustment means and said support means including second height adjustment means said first and second height adjustment means for selectively adjusting height of said table top relative to said top wall; and actuator means mounted on said table top and operatively connected to said first and second height adjustment means for selectively releasing said first and second height adjustment means to adjust said table top height and for reengaging said first and second height adjustment means to maintain said table top at a selected height, wherein said actuator means operates said first and second height adjustment means substantially simultaneously.

2. A cabinet unit supported on a support surface, said unit comprising:

a base unit having a first upright end wall, a second upright end wall opposite said first end wall, and a top wall defining thereon a horizontally enlarged upward facing first work surface, said top wall being fixed to and disposed between said first and second end walls;

a table top disposed upwardly of said first work surface and defining thereon a horizontally enlarged upward facing second work surface, said table top having first and second table end portions at opposite ends thereof;

a support leg depending downwardly from said table top adjacent said second table end portion for contact with a support surface, said support leg having wheel means in rolling contact with a support surface for facilitating pivoting of said table top;

pivot means pivotally connected between said first table end portion and said base unit adjacent said first end wall for permitting swinging movement of said table top relative to said base unit about a vertical pivot axis, said table top being swingable between a closed position and an open position, said first and second table end portions being disposed respectively adjacent said first and second end walls so that said table top overlies said top wall when in said closed position, said second table end portion being pivoted outwardly away from said second end wall when in said open position, said second table end portion being swingable about said pivot axis at least 180 degrees along a pivoting path; and said pivot means and said support leg including respective first and second height adjustment means for selectively adjusting the height of said table top between a first height position proximate said first work surface and a second height position spaced a selected distance upwardly away from said first height position.

3. A cabinet unit according to claim 2, wherein said base unit defines thereon a cabinet edge adjacent said second end wall, said cabinet edge being spaced from said pivot axis by a predetermined distance which is less than the distance between said pivot axis and said support leg so that said table top extends beyond said cabinet edge when in said closed position, said support leg being disposed proximate said cabinet edge and said second end wall when said table top is disposed in said closed position.

4. A cabinet unit according to claim 2, wherein a locking plate extends downwardly from said table top, said locking plate facing towards and being disposed closely adjacent said cabinet edge when at said first height position so as to substantially prevent horizontal swinging of said table top, said locking member and said cabinet edge being in a noninterfering relation when said table top is disposed at said second height position.

5. A cabinet unit according to claim 4, wherein said pivot means and said support leg each include first and second vertically telescoping members slidably engaged one with the other, said first and second adjustment means operatively engaged between said first and second telescoping members respectively to selectively fix one of said first and second telescoping members relative to the other to vary the overall length of said pivot means and said support leg.

6. A cabinet unit according to claim 5, including manually-operated actuator means mounted on said table top and operatively connected to said height adjustment means for releasing said height adjustment means to adjust said table height and for reengaging said height adjustment means to maintain said table top at said table height.

7. An upright free-standing cabinet unit for deposition on a support surface such as a floor, said unit comprising:

a base unit including a housing having first and second generally parallel and sidewardly-spaced upright end walls, and a top wall fixed to said end walls adjacent upper edges thereof and extending generally horizontally therebetween, said top wall defining thereon a generally horizontally enlarged and upwardly-facing top surface which functions as a first work surface, said top wall having a length as defined between first and second end edges which are respectively disposed adjacent said first and second end walls;

a generally horizontally enlarged table top defining thereon a horizontally enlarged upwardly-facing top surface which defines a second work surface, said table top always being disposed at a height above said top wall so that said second work surface is always at a height above the height of said first work surface;

said table top having a length as defined between first and second end edges thereof which is substantially greater than the length of said top wall, said table top having first and second table top end portions disposed adjacent the respective first and second end edges, said first table top end portion being disposed above said top wall in the vicinity of said first end wall;

pivot means connected between said first table top end portion and said housing in the vicinity of said first end wall and defining a vertical pivot axis for permitting said table top to be horizontally swingably moved relative to said top wall between a first position wherein said table top is disposed so as to substantially vertically overlie said top wall and a second position wherein said table top is horizontally angularly displaced through a significant angle relative to said first position, said table top when in said first position being disposed such that said second table top end portion projects horizontally outwardly beyond said second end wall;

a vertically elongate support leg structure fixed to an underside of said second table top end portion and projecting downwardly therefrom for supportive engagement with the support surface, said support leg structure being positioned adjacent but outwardly from said second end wall when said table top is in said first position;

first and second releasable height-adjusting means respectively associated with said leg structure and said pivot means for permitting the table top to be vertically raised from a lowered position wherein the table top is disposed at a height adjacent but above said top wall, and a raised position wherein said table top is spaced upwardly a substantial distance above said lowered position; and manually-activated actuator means mounted on said table top and interconnected to both of said first and second height-adjusting means for permitting release of said first and second height-adjusting means when movement of said table top between said raised and lowered positions is desired.

8. A cabinet unit according to claim 7, wherein said leg structure includes roller means mounted on a lower end thereof for rolling engagement with the support surface.

9. A cabinet unit according to claim 8, including a pivot restraining member mounted on said table top and projecting downwardly therefrom for engagement with said housing only when said table top is in said lowered position and is in said first position so as to prevent horizontal swinging movement of said table top relative to said housing.

10. A cabinet unit according to claim 7, wherein said actuator means includes a manually-engageable actuator lever pivotally mounted on said table top in the vicinity of an edge thereof, and first and second elongate flexible cable assemblies connected from said actuator lever to said first and second height-adjusting means, respectively, for permitting simultaneous activation thereof.

11. A cabinet unit according to claim 10, wherein said support leg structure and said pivot means each include inner and outer tubular elements which are vertically slidably telescoped one within the other so as to accommodate vertical height adjustment of said table top, and wherein said first height-adjusting means includes biasing means disposed interiorly of said support leg structure for normally biasing said support leg structure into an extended position so as to normally urge said table top toward said raised position.

12. A cabinet unit according to claim 11, wherein said first and second height-adjusting means each respectively include first and second releasable lock mechanisms which when in a locked position prevent vertical displacement of said table top, and said first and second cable assemblies being respectively interconnected to said first and second lock mechanisms for permitting release thereof in response to manual activation of said actuating lever.

13. A cabinet unit according to claim 7, wherein said housing includes at least one storage drawer disposed between said end walls and slidably supported on said housing.

14. A cabinet unit according to claim 7, wherein said housing includes an arcuate end wall which is fixed to said housing and is positioned adjacent and cooperates with said first end wall for defining an interior cavity therebetween, said pivot means being positioned so as to project downwardly into said interior cavity.

15. A free-standing cabinet unit comprising:

a base unit having a first upright end portion, a second upright end portion opposite said first end portion, and a top wall defining an upward facing first work surface fixed to and disposed between said first and second end portions;

a pivoting table top defining an upward facing second work surface and having a first table end portion, and a second table end portion opposite said first table end portion;

a vertically elongate support means mounted on and depending downwardly from said table top for contact with a support surface;

pivot means pivotally connected between said first table end portion and said base unit in the vicinity of said first upright end portion for enabling substantially horizontal pivoting movement of said table top relative to said base unit about an upright-oriented pivot axis between a closed position wherein said first and second table end portions are disposed respectively adjacent said first and second upright end portions so that said table top overlies said top wall and an open position wherein said second table end portion is horizontally pivoted outwardly away from said second upright end portion;

at least one of said pivot means and said support means including height adjustment means for selectively adjusting height of said table top relative to said top wall, wherein said table top height is adjustable between a first height proximate said top wall when in said closed position and a second height spaced upwardly away from said top wall; and locking means for engaging said base unit when said pivoting table top is positioned at said first height in said closed position to prevent pivoting of said table top relative to said base unit.

16. A cabinet unit according to claim 15, wherein said locking means is released to enable horizontal pivoting movement of said table top when said table top is disposed at said second height.

17. A cabinet unit according to claim 15, wherein said locking means is a projecting member depending downwardly from said table top proximate said second table end portion, said projecting member disposed on said table top a predetermined distance from said pivot means so as to be positioned closely proximate an edge of said second upright end portion when disposed in said closed position to prevent pivoting movement of said table top.

18. A free-standing cabinet unit comprising:

a base unit having a first upright end portion, a second upright end portion opposite said first end portion, and a top wall defining an upward facing first work surface fixed to and disposed between said first and second end portions;

a pivoting table top defining an upward facing second work surface and having a first table end portion, and a second table end portion opposite said first table end portion;

a vertically elongate adjustable support means mounted on and depending downwardly from said table top for contact with a support surface, said support means including an outer tubular member and an inner tubular member telescopingly received within said outer tubular member to vary the overall length of said support means;

pivot means pivotally connected between said first table end portion and said base unit in the vicinity of said first upright end portion for enabling substantially horizontal pivoting movement of said table top relative to said base unit about an upright-oriented pivot axis between a closed position wherein said first and second table end portions are disposed respectively adjacent said first and second upright end portions so that said table top overlies said top wall and an open position wherein said second table end portion is horizontally pivoted outwardly away from said second upright end portion;

height adjusting means disposed within said adjustable support means for selectively adjusting height of said table top relative to said top wall, said height adjustment means including a pressure cylinder fixed relative to one of said inner and outer tubular members, a reciprocating cylinder rod which extends from said pressure cylinder and has a distal end fixed relative to the other of said inner and outer tubular members;

actuator means mounted on said table top and operatively connected to said height adjustment means for selectively releasing said height adjustment means to adjust said table top height and for reengaging said height adjustment means to maintain said table top at a selected height, and releasable locking means to fix the position of said inner tubular member relative to said outer tubular member.

* * * * *